US006400343B1

(12) United States Patent
Zorzan et al.

(10) Patent No.: US 6,400,343 B1
(45) Date of Patent: Jun. 4, 2002

(54) METHOD FOR ACTIVATING THE CELLS OF AN IMAGE DISPLAYING SCREEN, AND IMAGE DISPLAYING DEVICE USING SAME

(75) Inventors: Philippe Zorzan, Grenoble; André Dunand, Voreppe, both of (FR)

(73) Assignee: Thomson-CSF, Paris (FR)

( * ) Notice: Subject to any disclaimer, the term of this patent is extended or adjusted under 35 U.S.C. 154(b) by 0 days.

(21) Appl. No.: 09/202,980

(22) PCT Filed: Jun. 24, 1997

(86) PCT No.: PCT/FR97/01123

§ 371 (c)(1),
(2), (4) Date: Dec. 24, 1998

(87) PCT Pub. No.: WO98/00826

PCT Pub. Date: Jan. 8, 1998

(30) Foreign Application Priority Data

Jun. 28, 1996 (FR) ..... 96 08079

(51) Int. Cl.[7] ..... G09G 3/28
(52) U.S. Cl. ..... 345/60; 345/63; 345/204
(58) Field of Search ..... 345/60, 61, 62, 345/63, 64, 65, 66, 67, 68, 69, 70; 315/169.4

(56) References Cited

U.S. PATENT DOCUMENTS

| | | | | |
|---|---|---|---|---|
| 5,081,400 A | | 1/1992 | Weber et al. | |
| 5,438,290 A | * | 8/1995 | Tanaka | 315/169.4 |
| 6,011,355 A | * | 1/2000 | Nagai | 345/60 |
| 6,111,556 A | * | 8/2000 | Moon | 345/60 |

FOREIGN PATENT DOCUMENTS

EP 0 704 834 * 4/1996

* cited by examiner

*Primary Examiner*—Xiao Wu
(74) *Attorney, Agent, or Firm*—Oblon, Spivak, McClelland, Maier & Neustadt, P.C.

(57) ABSTRACT

A method for activating the cells of an image display screen. Electric potential signals called activation signals are produced to activate the cells and to supply the current consumed by this activation. An electric potential is applied to a solenoid so as to develop the activation signals at the solenoid terminals and to cause a change in the main current in the solenoid which serves as the current consumed by the cell activation. Thus, cell activation control of the "current supply" type is effected, and is particularly suited for the delivery of large amounts of current in a short time. This may be used in image display screens such as plasma panels.

42 Claims, 8 Drawing Sheets

FIG.2a
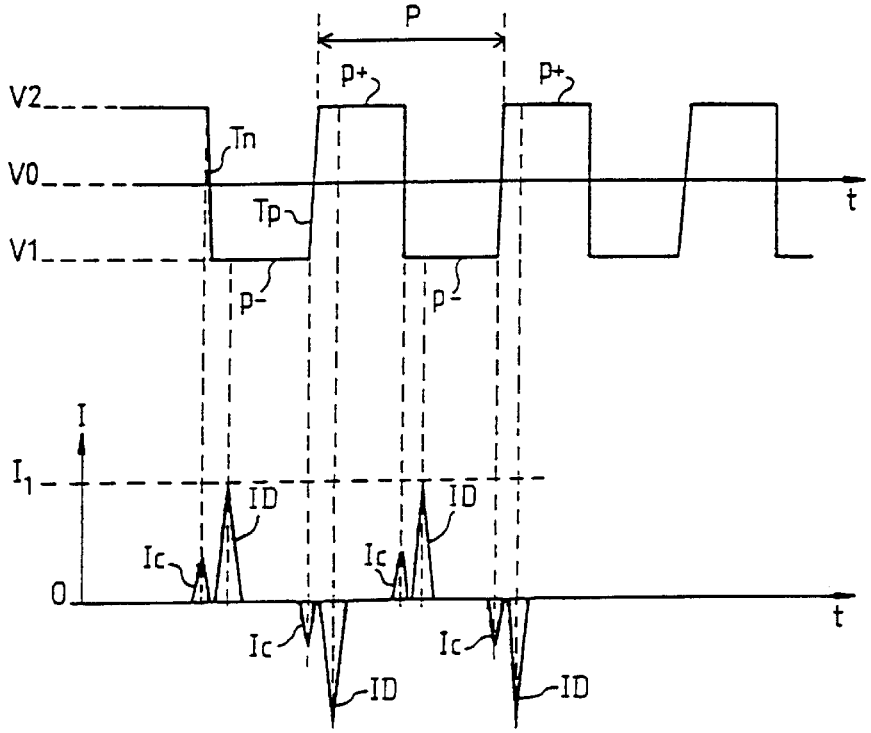
FIG.2b
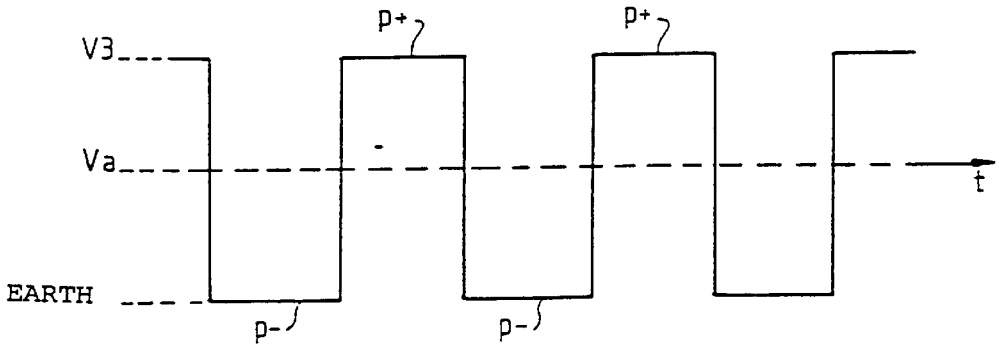
FIG.7 t0' t1 t2 t2' t3' t4 t5 t5' t6 t6'
t3
V2
SE
V0
V-
p+
p-
t

Imax+
IL
0
Imax-
T1
T2

CONDUCTION
NON CONDUCTION
D2

"ON"
"OFF"
S1

ID
IDa
IDb

D1

S2

D3

S3

D4

S4

METHOD FOR ACTIVATING THE CELLS OF AN IMAGE DISPLAYING SCREEN, AND IMAGE DISPLAYING DEVICE USING SAME

BACKGROUND OF THE INVENTION

1. Field of the Invention

The present invention relates to a process for activating cells forming the elementary image points of an image display screen. It applies advantageously in cases in which the activation of the cells demands the provision of a current of short duration and high intensity. The invention also relates to an image display device which uses this process.

2. Discussion of the Background

The activation of the cells of a display screen demands the provision of a current whose intensity is all the higher the larger the number of cells to be activated simultaneously.

These conditions are found in various types of display screen to which the invention may therefore be applied, especially plasma panels, screens with light-emitting diodes, liquid crystal screens, or else screens of the type whose elementary cells use a so-called "needle effect" phenomenon so as each to produce a beam of electrons. It should be noted that the simultaneity of actuation of the cells is more definite in screens which employ an effect termed the "memory effect".

Taking for example the screens of plasma panels in which the activation of the cells calls for a sizable current, and more particularly plasma panels (abbreviated to "PAPs") of the ac type all of which employ the "memory effect", there are various types of ac PAPs: for example those which use just two crossed electrodes to define a cell, as described in French Patent FR 2,417,848; or again, ac PAPs of the so-called "coplanar sustain" type, which are known in particular in respect of the European Patent document EP-A-0,135,382, and in which each cell is defined at the crossover of a pair of so-called "sustain" electrodes, with one or more other electrodes used more particularly for addressing the cells.

The manner of operation of an ac PAP is explained below with reference to FIG. 1. To simplify the explanations, the diagram shown in FIG. 1 is that of a PAP with two crossed electrodes defining a cell.

The PAP comprises a network of electrodes Y1 to Y4 termed "row electrodes", crossed with a second network of electrodes X1 to X4 termed column electrodes. To each intersection of row and column electrodes there corresponds a cell C1 to C16. These cells are thus arranged in rows L1 to L4 and columns.

In the example of FIG. 1, just 4 row electrodes Y1 to Y4 and 4 column electrodes X1 to X4 are represented, which define 16 cells C1 to C16 serving to form the display screen 1 of the PAP, but in practice, an ac PAP can comprise 1000 or more row electrodes and as many column electrodes, serving to define 1 million or more cells.

Each row electrode Y1 to Y4 is linked to an output stage SY1 to SY4 of a row control device 2, and each column electrode X1 to X4 is linked to an output stage SX1 to SX4 of a column control device 3. These two control devices 2, 3 are driven by an image management device 4.

The row control device 2 comprises a so-called "sustain" generator 5 responsible for producing cell activation signals termed "sustain signals" SE. The sustain generator 5 delivers the sustain signals SE via an output circuit 6, which itself distributes them to each output stage SY1 to SY4 so that these signals SE are applied simultaneously to all the row electrodes Y1 to Y4.

It should be noted that a capacitance c PAP which symbolizes a so-called global capacitance exhibited by all PAPs has been depicted with dashed lines at the output of the sustain generator 5.

In a PAP, the elementary cell experiences just two states: the so-called "lit" or "written" state and the so-called "unlit" or "erased" state. In the "lit" state it can produce an electric discharge which itself produces light; in the so-called "unlit" state there is no discharge produced, and hence no light emitted. ac PAPs have in common that they benefit naturally, of not their technology, from the "memory effect" mentioned above. The term "memory effect" is understood to mean the effect which allows cells having two stable states to retain one or other of these states after the signal which triggered this state has disappeared.

In ac PAPs, the "memory effect" is used with the aid of the sustain signals SE to activate the cells C1 to C16 which are in the "lit" state, that is to say to bring about discharges and hence emissions of light in these cells, without modifying their "lit" state or modifying the state of the cells which are in the "unlit" state.

It should be noted that the cells C1 to C16 are placed in the "lit" state or in the "unlit" state as a function of the image which is to be produced, by addressing operations which are usually performed row by row. For this purpose, the row control device 2 generally comprises elements (not represented) which cooperate with the row output stages SY1 to SY4 so as, when a given row L1 to L4 is addressed, to superimpose addressing-specific signals on the sustain signals SE and to do so solely for the row electrode Y1 to Y4 which corresponds to the row L1 to L4 addressed.

FIG. 2*a* represents the sustain signals SE and FIG. 2*b* illustrates the phase relation between the inrush currents drawn by the row control device 2 and the sustain signals SE.

The sustain signals SE consist of voltage strobes following one another with a period P of the order of for example 8 to 10 microseconds.

These strobes are established on either side of a reference potential Vo which is for example earth. They vary between a negative potential V1, in which they exhibit a so-called negative plateau p−, and a positive potential V2 in which they exhibit an opposite plateau to the previous so-called positive plateau p+. These positive and negative potentials V2, V1 each have for example a value of 150 volts with respect to the reference potential Vo.

The reference potential Vo is applied to the column electrodes X1 to X4 in such a way that the sustain signals SE develop alternately positive and negative voltages, of 150 volts in the example, across the terminals of the cells C1 to C16, each of these voltages giving rise to a discharge in those cells which are in the "lit" state.

These discharges in the cells C1 to C16. occur slightly after each negative or positive transition Tn, Tp of the voltage of the sustain signals, of the order for example of a few hundred nanoseconds after the establishing of the positive and negative plateau. To each of these discharges in the cells there corresponds an inrush current termed the "discharge current" ID which is provided by the row control device 2. In FIG. 2*b* it may be seen that the discharge current ID is in fact established after each start of a positive and negative plateau. Of course, the discharge current ID changes direction depending on whether it is established on the basis of a positive plateau p+ or a negative plateau p−.

The existence is also observed of another inrush current termed the "capacitive current" Ic which is in phase with each transition Tn, Tp of the sustain signals and which corresponds to the current required to charge, alternately positively and negatively, the overall capacitance c PAP exhibited by the PAP. This global capacitance of the PAP, of non-negligible value, is constituted by various stray capacitances and the like exhibited in particular by the screen 1 itself and which are formed for example by the row and column electrodes Y1 to Y4 and X1 to X4, the printed circuit tracks and the various connections and circuits, plus the stray capacitances exhibited by the elements responsible for deriving the sustain signals SE in the row control device 2. Thus, for example, the global capacitance c PAP can have a value of 10 nF in the case of a screen 1 having 4 or 5 $dm^2$, possessing for example 512 row electrodes and 512 column electrodes which constitute 512×512 cells. Of course, the value of the global capacitance c PAP depends greatly on the technologies employed.

The discharge current ID corresponds to the sum of the currents consumed simultaneously by the discharges from all the cells which are in the "lit" state. Its intensity can therefore vary considerably. The maximum intensity I1 of the discharge current ID, in the case of a screen having 512 row electrodes and 512 column electrodes, can attain a sizable value, of 10 amperes for example, which value itself also depends on the technologies employed.

The provision by the row control device 2 and more precisely by the sustain generator 5, of the sustain signals SE under a current whose intensity is as considerable as the maximum intensity I1, in a short time, poses problems which will be better understood with the aid of the explanations which follow regarding the manner of operation of the sustain generator 5 shown in FIG. 1.

The sustain generator 5 comprises a negative voltage source 7 and a positive voltage source 8, which respectively deliver the negative V1 and positive V2 voltages corresponding to the potentials of the negative and positive plateaux p−, p+ of the sustain signals SE.

The voltage sources 7, 8 are linked to a common point Pc, each by way of a switch element 10, 11. These switch elements consist for example of MOS type transistors, which make it possible to pass, in very short times, from a "closed" or "on" state in which they close the circuit, to an "open" or "off" state in which they open the circuit.

The switching elements 10, 11 are controlled from a clock device 13 by which they are turned "on" or "off".

Thus, by turning "on" the switching element 10 in series with the negative voltage source 7, the negative plateau p− of the sustain signals SE is established at the common point PC; then by turning "on" the switching element 11 placed in series with the positive voltage source 8, the positive plateau p+ of these sustain signals is established at the common point PC, the other switching element 10 having of course been turned "off".

From the common point PC the sustain signals SE are transmitted to the output circuit 6 from where they are distributed to each of the output stages SY1 to SY4.

The discharges in the various cells C1 to C16 occur almost simultaneously, so that the discharge current ID is established and attains its maximum intensity Y1 in a very short time, of the order of 100 to 150 nanoseconds for example.

The voltage sources 7, 8 do not manage to deliver, with the required qualities, voltages V1, V2 nor the discharge current ID under which these voltages are delivered. This is due in particular to the internal resistances of the voltage sources 7, 8, which internal resistances are far from being negligible even for particularly sophisticated voltage sources, as is the case for those which are commonly used to fulfil the functions of the sources 7, 8.

The detrimental effects which result from this are for example:

- sizable voltage drops and internal dissipations;
- sizable time constants for the responses to the inrush currents;
- relatively sizable variations in the voltage values V1, V2 as a function of the value of the discharge current ID.

These drawbacks are added to the high cost of the sources 7, 8 which must be used.

In addition to the limitations introduced by the voltage sources 7, 8, there are also limitations due to the switch elements 10, 11. This is because the whole of the discharge current ID passes alternately through one or other of these two switches 10, 11. These switches 10, 11 themselves also exhibit a non-negligible internal resistance (when they are in the "closed" state), which provokes large voltage drops at their terminals. These voltage drops are all the more detrimental since their value varies with the variations in the intensity of the discharge current ID.

Under these conditions, and having regard to the various existing capacitances, the sustain generator 5 cannot always deliver the sustain signals under a current established in a fairly short time so as not to impair the physical phenomenon of the discharge in the cells.

These various limitations give rise to defects in the image displayed, such as in particular a variation in luminance as a function of the contents of the image, or else exaggerations or even reversals of the disparities in luminance between various regions of the image.

With a view to remedying these defects, a known solution consists in augmenting or in overdimensioning all or some of the elements which participate in order to derive the sustain signals SE and apply them to the cells, as well as in choosing and selecting the components. However, this solution greatly increases the costs while affording only partial improvements.

SUMMARY OF THE INVENTION

One of the aims of the present invention is to reduce or even eliminate the defects in the feeding of voltage and current to the cells, and more particularly the defects related to the shortcomings of the generator which produces the cell activation signals, that is to say the sustain signals in the case of a PAP. To this end, the invention proposes to power the cells with the aid of a solenoid, so as to produce a current source which is more suitable than the conventional sustain generators for providing currents of very short duration and very high intensity.

The invention relates to a process for activating the cells of an image display screen, consisting in cyclically producing signals termed "activation" signals and in applying them to the cells, the activation signals having a period during which they engender at least one phase of activation of the cells, the activation of the cells determining a consumption of a current termed the "discharge"current, the process being characterized in that in order to produce the activation signals, it consists in tapping off at the terminals of a solenoid, signals resulting from the application of at least one voltage to the solenoid, and in that it consists in causing a so-called "main" current to increase and decrease in the said solenoid, of which current at least a part, in the course of the decreasing, constitutes the discharge current.

The invention also relates to an image display device comprising a screen having a plurality of cells and exhibiting a so-called global capacitance, a control device delivering activation signals whose application to the cells produces, cyclically, an activation thereof, the activation of the cells engendering the consumption of a current termed the discharge current, characterized in that the control device comprises a solenoid cooperating with switching means and at least one voltage source so as on the one hand, to produce at the terminals of the solenoid, signals serving to constitute the activation signals, and on the other hand so as to cause a current termed the main current which, at some time in its decrease, serves to constitute the discharge current, to increase and decrease in the solenoid.

BRIEF DESCRIPTION OF THE DRAWINGS

The invention will be better understood and other advantages which it affords will emerge on reading the following description given by way of non-limiting example with reference to the appended figures in which:

FIGS. 2*a*, 2*b* already described show signals serving to activate cells shown in FIG. 1;

FIG. 7 represents the signals obtained with the setup shown in FIG. 6;

DETAILED DESCRIPTION OF THE PREFERRED EMBODIMENTS

Figure 3:
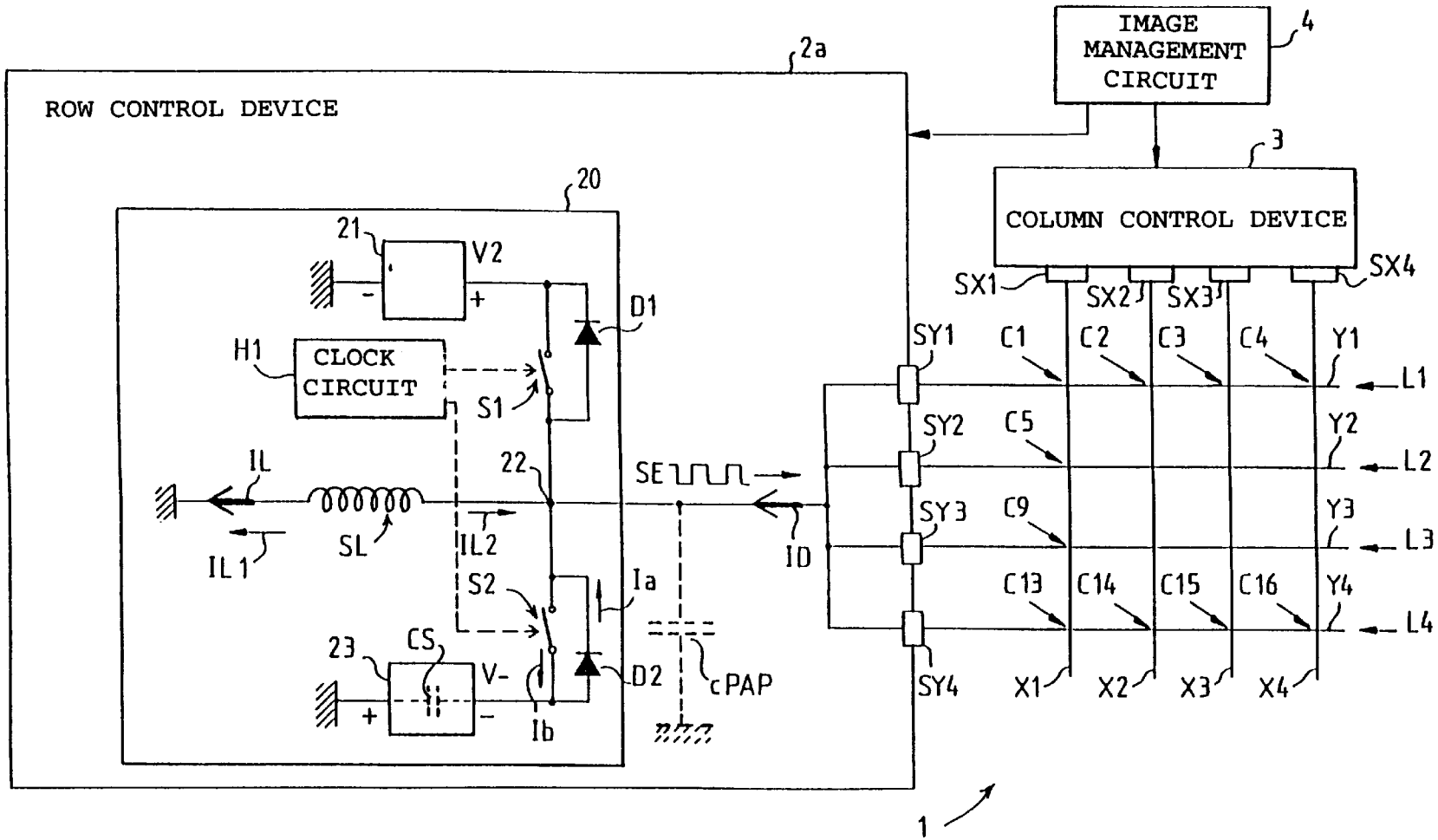
FIG. 3 diagrammatically represents a plasma panel according to the invention making it possible to implement the process of the invention.

FIG. 3 diagrammatically represents an image display device according to the invention, making it possible to power cells so as to activate them in accordance with the process of the invention.

Figure 1:
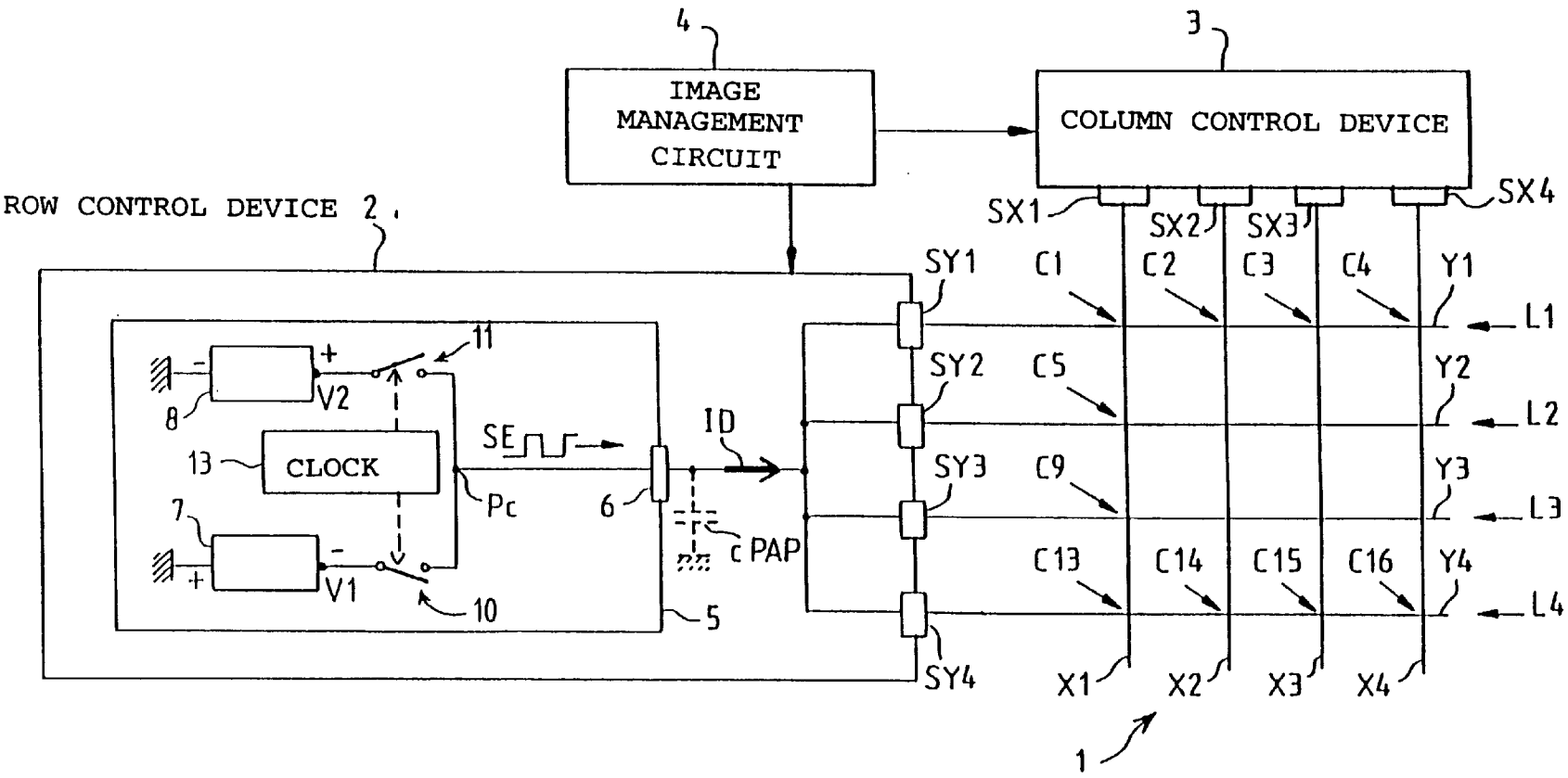
FIG. 1 already described represents a plasma panel according to the prior art.

In the non-limiting example described, the display device is an ac plasma panel or PAP, similar to the conventional PAP shown in FIG. 1, except as regards the row control device.

The PAP of the invention comprises a display screen 1 similar to that shown in FIG. 1, as well as a row control device 2A, a column control device 3 and an image management device 4 which are organized around the screen 1, in the same way as in the case of the prior art already explained with reference to FIG. 1. The sole difference between the PAP according to the invention, represented in FIG. 3, and the conventional PAP resides in the manner of deriving the signals for activating the cells C1 to C16, that is to say the sustain signals SE in the case of a PAP, which signals are delivered by the row control device 2A.

The row control device 2A of the invention comprises an activation signals generator 20 by which the activation signals or sustain signals SE are produced, and which delivers them to the output stages SY1 to SY4 of the row control device 2A.

According to a characteristic of the invention, the signal generator 20 comprises a solenoid SL responsible for delivering the discharge current ID consumed by activated cells C1 to C16.

To this end, the signal generator 20 furthermore comprises a first voltage source 21, whose negative output "–" is linked to a reference potential Vo which is earth in the example, in such a way as to deliver a positive voltage V2, of 150 volts for example, via its "+" output. This "+" output is linked by way of a first switching element S1 fulfilling a switch function, at a point which constitutes the output 22 of the signal generator 20, through which output 22 this generator delivers the sustain signals SE. A first diode D1 is connected in parallel with the first switching element S1 or first switch S1, with the anode on the output 22 side and its cathode towards the first voltage source 21.

One of the ends of the solenoid SL is linked to the reference potential Vo constituted by earth, and its other end is linked to the output point 22. A second switching element or second switch S2 possesses an end connected to the output point 22, and its other end is linked to the negative output V– of a second voltage source 23 whose positive output "+" is linked to earth. Represented within the square serving to symbolize the second voltage source 23 is a capacitor cS represented by dashed lines, so as to illustrate the possibility of replacing one or other of the two voltage sources 21, 23 by a capacitor, as is explained further in the ensuing description. The negative voltage V– has a value of for example 150V. A second diode D2 is mounted in parallel with the second switch S2, the anode and the cathode of this second diode D2 being linked respectively to the second voltage source 23 and to the output point 22.

The first and second switches S1, S2 are of a type similar to the switching elements 10, 11 used in the sustain generator 5 shown in FIG. 1. They are controlled so as to be placed either in an "on" state in which they close the circuit, or in an "off" state in which they open the circuit. These switches S1, S2 are controlled by a clock circuit Hi which is in itself conventional, cyclically delivering signals which turn the switches S1, S2 "on" or "off", according to the manner of the operation described below.

It should be noted that the global capacitance c PAP (already mentioned) exhibited by each PAP has been represented by dashed lines in the vicinity of the output 22 of the signal generator 20.

The principle of operation is to use a solenoid as a current generator. A current IL termed the "main current" is made to increase and decrease linearly in the solenoid between zero and a value of intensity Imax, of value at least equal to the discharge current ID. The following operation is obtained: when the discharge occurs in the..cells, the main current IL in the solenoid SL has just begun to decrease after having attained Imax. The energy in the solenoid is almost equal to ½ L.ImaX$^2$ (L being the value of the solenoid SL) and the main current IL tries to flow through all the possible paths. It will therefore naturally flow through the cells in the "lit" state of the screen 1 at the time of the discharge and thus allow the cells to be lit.

FIGS. 4*a* to 4*g* constitute a timing diagram which illustrates the operation explained above.

Figures 4A, 4B, 4C, 4D, 4E, 4F, 4G:
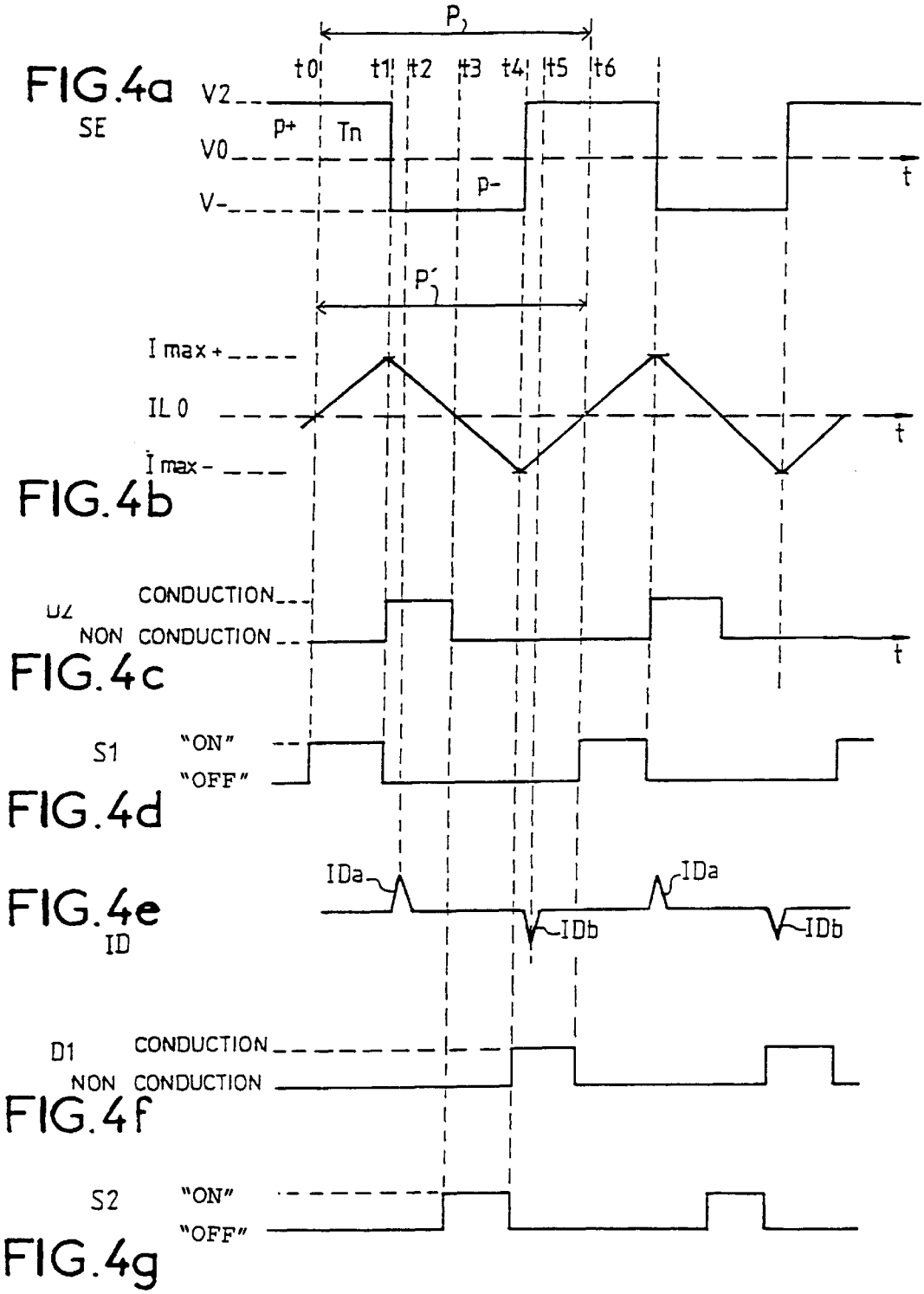
FIGS. 4*a* to 4*g* form a timing diagram illustrating the implementation of the process of the invention.

FIG. 4*a* represents the voltage signals developed at the terminals of the solenoid SL, that is to say exhibited at the output point 22 and which constitute the sustain signals SE.

FIG. 4*b* represents the profile over time of the main current IL in the solenoid SL.

FIG. 4*c* represents conduction through the first diode D1.

FIG. 4*d* represents conduction of the first switch S1.

FIG. 4*e* represents the discharge current ID by spikes IDa, IDb which illustrate the reversing of the direction of the discharge current during two consecutive discharges.

FIG. 4*f* represents conduction by the second diode D2.

FIG. 4*g* represents conduction by the second switch S2.

At an instant to at which the main current IL in the solenoid is at zero (FIG. 4*b*), the first switch S1 is set to the "on" state and the positive voltage V2 delivered by the first source 21 is applied to the output point 22. As a result of this, on the one hand the sustain signals SE are at the value of the positive voltage V2 in a phase which corresponds to a portion of positive plateau p+ and, on the other hand the main current IL increases linearly with a slope equal to V2/L, with a first direction of flow IL1.

At an instant t1, the clock circuit H1 triggers the turning "off" of the first switch S1. Consequently, the first voltage source 21 is no longer linked to the output point 22 nor to the solenoid SL, and hence the positive voltage V2 is no longer applied to the solenoid. This gives rise to an oscillatory type response of the oscillating circuit SL–c PAP which then consists of the solenoid SL and the global capacitance c PAP. This oscillatory response is manifested, at the output point 22, as a voltage variation whose amplitude is limited to the value of the negative voltage V–, by virtue of the conducting of the second diode D2 which fulfils a clipping function. This voltage variation constitutes a negative transition Tn of the sustain signals SE which thus, at the instant t1, pass from a positive plateau p+ to a negative plateau p–. In parallel with this, the end of the application of the positive. voltage V2 at the instant t1 brings about the end of the linear increase in the main current IL. The latter begins to decrease with a slope substantially equal to that which it had for its increase. This decrease commences with the start of the negative plateau p–.

At an instant t2 which follows the instant t1 by a time of the order of 200 nanoseconds, the discharges occur in the cells C1 to C16 of the screen 1, which discharges are depicted in FIG. 4*e* by a spike IDa representing a discharge current consumed by the set of cells C1 to C16 in the "lit" state, and which constitutes all or some of the main current IL which is itself then at the start of its decrease. The time interval between the instant t1, onwards of which the sustain signals SE are at the negative potential V–, and the instant t2 at which the discharges occur thus represents an activation phase.

At an instant t3 on the one hand the main current IL vanishes and the second diode D2 is no longer conducting, and on the other hand the second switch S2 is commanded so as to be in the "on" state, that is to say to close the circuit. Hence, onwards of the instant t3 the solenoid SL is linked to the negative output V– of the second voltage source 23 directly via the second switch S2: the main current IL in the solenoid begins to increase in the second direction of flow IL2 and continues to grow linearly up to the intensity value Imax–, with a slope equal to V–/L; on the other hand, the application of the negative voltage V– to the output point 22 produces the second portion of the negative plateau p– of the sustain signals SE.

At an instant t4 at which the main current IL has substantially attained its maximum intensity value Imax–, the second switch S2 is turned "off", that is to say it opens the circuit, the negative voltage V– is no longer applied. A situation similar to that described for the instant t1 holds: the circuit amounts to an oscillating circuit L–c PAP; there is again an oscillatory type voltage variation with regard to the voltage of the sustain signals SE, with the amplitude of this variation now being limited to the value of the positive voltage V2, through the conducting of the first diode D1 which fulfils a clipping function. This variation in voltage now constitutes a positive transition p+ which causes the sustain signals to pass from the negative plateau p– to a positive plateau p+. In parallel with this, the end of the application of the negative voltage V– at the instant t4 brings about the end of its increase with a linear slope substantially equal to that of its increase.

At an instant t5 the discharges occur in the cells C1 to C16, which discharges are depicted in FIG. 4*e* by a spike IDb representing a discharge current consumed globally by the cells in the "lit" state. This discharge current provided by the solenoid SL at the start of the decrease of the main current IL constitutes a share of the latter, the magnitude of which depends on the number of the cells C1 to C16 in which a discharge occurs. It should be noted that this discharge current IDb possesses a direction opposite to that of the discharge current IDa which occurred at the instant t2 after the establishing of the negative plateau p– of the sustain signals SE. The time interval formed between the instants t4 and t5 thus constitutes a second activation phase.

At an instant t6 the main current IL in the solenoid vanishes and the first diode D1 ceases to conduct; the first switch S1 is turned "on". Hence, onwards of the instant t6 the positive voltage V2 is applied by the first switch S1 to the solenoid SL and the main current IL in the latter continues to evaluate linearly, that is to say it begins increasing again up to the intensity value Imax+. It should be noted that the application of the positive voltage V2 to the solenoid and hence to the output point 22 produces the second portion of the positive plateau p+ of the sustain signals SE.

The sequences included between the instant to and the instant t6 describe a complete cycle of operation, showing the variations of the main current IL in the solenoid SL, as well as the variations of the voltage developed at its terminal, and showing the production of the sustain signals SE. These sequences are repeated in the same way in the ensuing operation, the instant t6 constituting the instant to of the next cycle.

It may be observed on the one hand that the increase in the main current IL, which constitutes storage of energy in the solenoid SL, takes place in a time which in the example is of the order of half the duration of a positive or negative plateau p+, p–, i.e. slightly less than a quarter of the period P of the sustain signals SE, that is to say of the order of 2 microseconds.

Under these conditions, the voltage sources 21, 23 can provide voltage and current with no problems, and can therefore be constructed with ordinary and hence less expensive technology than in the prior art in which the current consumed during discharges must be delivered in the order of a 10th of the time, i.e. around 200 nanoseconds.

It may be observed on the other hand that the releasing by the solenoid of the energy stored, corresponding to the decreasing of the current IL, makes it possible to provide the discharge current ID with the desired intensity and desired rate of establishment without any problem in respect of the solenoid SL.

The intensity value Imax+ or Imax– of the main current IL in the solenoid is determined so as to meet two criteria, one of which is that it must be large enough to make it possible to provide the discharge current ID through the cells C1 to C16. In the example described, the discharge current to be provided is of the order of 10 amperes, peak value.

The other criterion for determining the intensity of value Imax, is that this value must allow a sufficiently fast transition Tn, Tp of the sustain signals SE.

Although these transitions take place during a sinusoidal regime, the following approximation may be made: the solenoid behaves like a generator of a current of intensity Imax which will discharge the capacitor c PAP.

If the voltage transition to be effected is called dV and the desired transition time is called dt, the following relation holds:

$$dV = \frac{1}{cPAP} \cdot Imax \cdot dt,$$

from which it follows that:

$$Imax = cPAP \cdot \frac{dV}{dt}$$

For a value of global capacitance c PAP of for example 10 nF, and a voltage transition dV of 300 volts, we find Imax=10 amperes, dt=300 ns.

The 10 amperes of the current IL corresponding for example to the value Imax+, must be obtained in a few microseconds with a voltage V2 of the order of 150 V. Considering the conduction time of the first switch S1 denoted TS1 equal to 2 microseconds $$\text{then: } Imax = \frac{V2}{L} \cdot TS1$$

$$\text{hence: } L = \frac{V2 \cdot TS1}{Imax}$$

Numerical application gives L=30 microhenrys.

As already mentioned above, one or other of the positive and negative power sources 21, 23 could be replaced by a capacitor fulfilling an electric charge reservoir function.

Taking for example the second voltage source 23 which delivers a negative voltage V−, this negative voltage V− can also be obtained by replacing the voltage source 23 by a so-called storage capacitor cS, with a value of 20 microfarads for example. This is because the currents Ia and Ib which in the manner of operation described above flow alternately, the first through the second diode D2 and the second through the second switch S2, create a negative voltage by carrying off and pulling charges in the vicinity of the capacitor cS which stores these charges. Equilibrium is obtained (mean value of V− constant) when the quantity of charge stored in one direction (Ia) is equal to that which is tapped off in the other direction (Ib).

In the case in which the sustain signals SE produced are such as represented in FIG. 4*a*, this equilibrium is obtained when the value of the negative voltage V− is equal (sign excluded) to the value of the positive voltage V2, since the duty ratio of the signals or negative and positive plateaux which constitute the sustain signals SE is equal to 1.

Figure 5A:
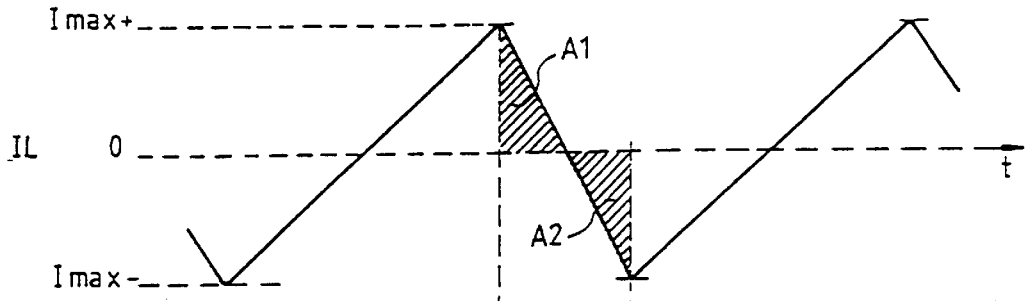
FIGS. 5*a* and 5*b* respectively show a current established in a solenoid and sustain signals developed at the terminals of this solenoid, in the case in which these sustain signals exhibit a duty ratio different from 1.
Figure 5B:
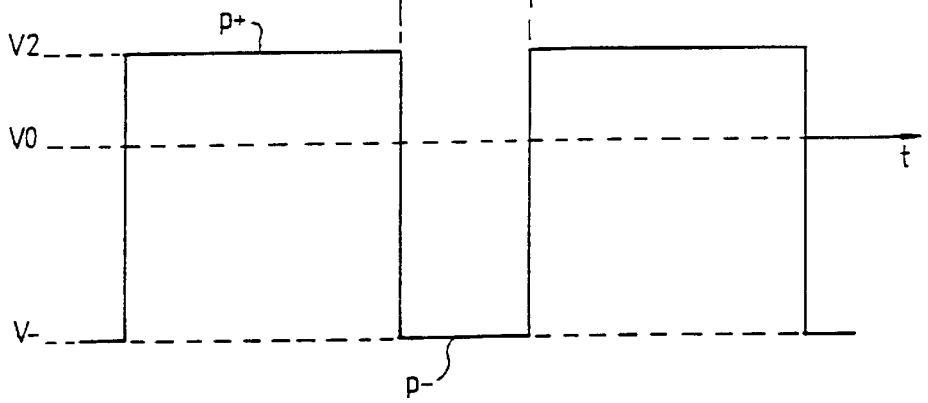

FIGS. 5*a* and 5*b* illustrate a case in which the sustain signals exhibit a duty ratio different from 1, and in which the negative voltage V− is obtained with a storage capacitor cS.

It may in fact be beneficial, especially for reasons of addressing control, to produce sustain signals SE having a duty ratio different from 1, with for example longer positive plateaux p+ than negative plateaux p−. This can be achieved easily for example by modifying the duration and the instants at which the second switches S2 and/or the first switch S1 are triggered.

FIG. 5*a* represents the main.current IL in the solenoid SL. This current varies between the value Imax+ and the value Imax−, on either side of the value O. A first and a second hatched area A1, A2 on the curve of the main current IL, represent the quantities of charge transferred in the storage capacitor cS.

FIG. 5*b* represents the sustain signals SE, whose positive plateaux p+ are longer than the negative plateaux p−. The positive plateaux p+ correspond to the positive voltage V2 and the negative ones p− correspond to the negative voltage V−.

It can be observed that it is during a negative plateau p− that these transfers of charge in the capacitor cS occur. The two areas A1, A2 must be equal, thus implying that the intensity values Imax+ and Imax− are equal, and the negative voltage V− will take the value which allows this equality to be obtained. In the example represented in which the negative plateaux p− are of shorter duration than the positive plateaux p+, the negative voltage V− will take an absolute value greater than the value of the positive voltage V2, so as to cause the main current IL in the solenoid SL to vary over the duration of the negative plateau p− up to the same absolute value of Imax− as the value imax+.

Figure 6:
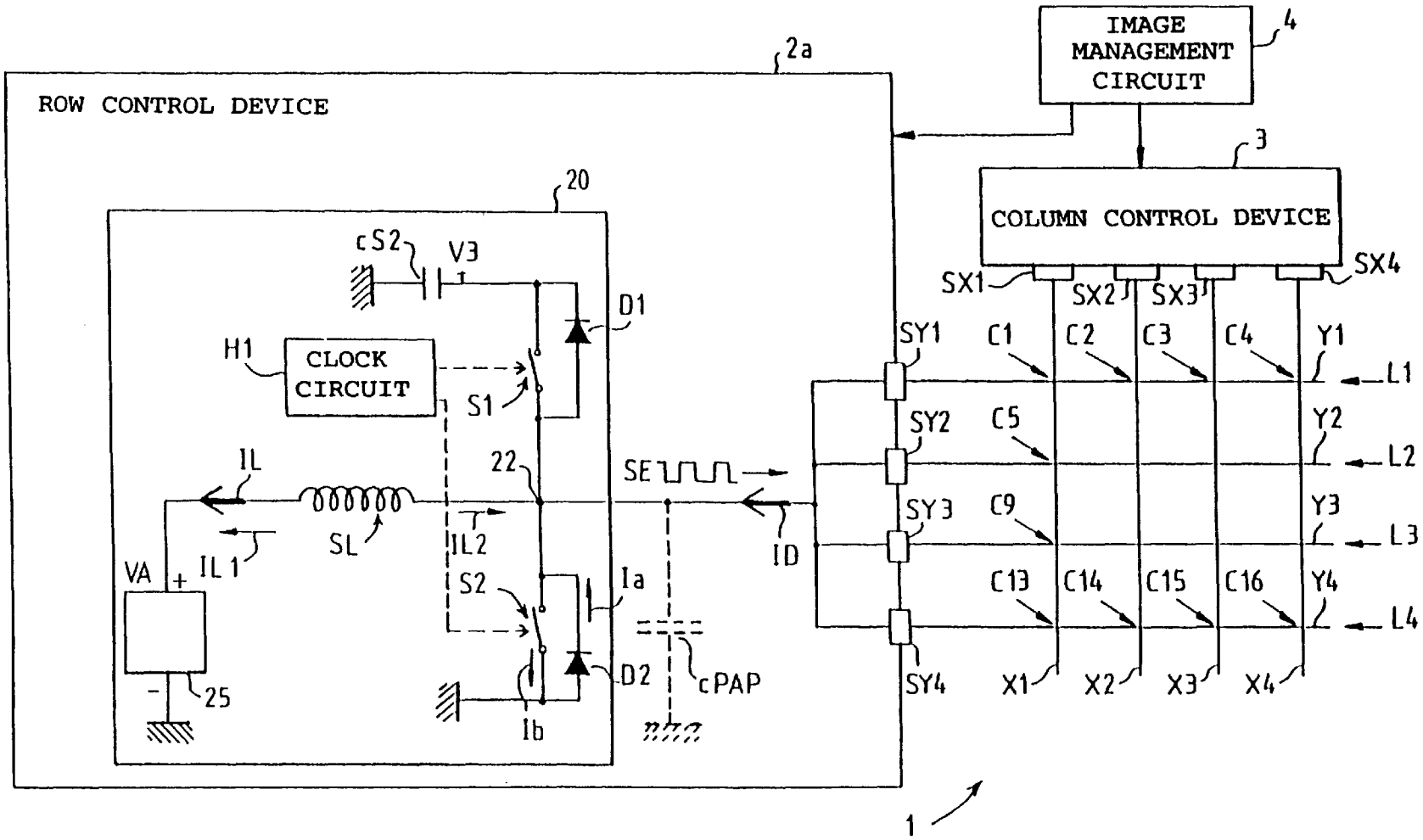
FIG. 6 diagrammatically represents a variant of the invention making it possible to produce sustain signals SE whose negative plateaux are at the potential of earth.

FIG. 6 represents the activation signals generator 20 already shown in FIG. 3, in a version which produces the current IL in the solenoid under the same conditions as those explained with reference to FIGS. 3 to 5, but which makes it possible to produce sustain signals SE whose negative plateaux p− are at the potential of earth.

The diagram of the activation generator 20 is different from that shown in FIG. 3 in that:

a)—the opposite end of the solenoid SL from the output point 22 is linked to the positive output "+" of a voltage source 25, the negative output "−" of which is linked to the earth potential; the voltage source 25 thus delivers a positive voltage Va;

b)—the opposite end of the second switch S2 from the output point 22 is linked to the earth potential;

c)—the opposite end of the first switch S1 from the output point 22 is linked to a plate of a second so-called storage capacitor cS2, the other plate of which is linked to the earth potential.

If under these conditions the switches S1, S2 are turned "on" and "off" in the same way, that is to say according to the same sequences as those explained with reference to FIGS. 4*d* and 4*g*, so as to produce sustain signals SE having a duty ratio of 1, a voltage V3 developed at the terminals of the second storage capacitor acquires a value equal to twice those of the voltage VA, i.e. V3=2×Va.

Assuming that VA possesses a value of 150 volts, similar operation to that of diagram of FIG. 3 is obtained, with the difference that in the case depicted in FIG. 6, the reference potential is no longer earth, but it consists of the positive potential of the.voltage VA, and that the earth constitutes the most negative potential. Another difference resides in the fact that the positive. potential which makes it possible to constitute the positive plateaux p+ of the sustain signals SE is obtained with the aid of a capacitor cS2, by equilibrium of quantities of charge transported, according to a manner of operation of the same type as those already explained in the case in which the negative voltage V− is obtained with the aid of the first storage capacitor cS1.

Of course, the positive voltage V3 could also be obtained by replacing the storage capacitor cS2 by a conventional voltage source.

FIG. 7 represents the sustain signals obtained with the setup described with reference to FIG. 6.

It may be seen that the sustain signals SE consist of voltage strobes established on either side of a reference potential which is the potential of the positive voltage Va; that the negative plateaux p− are at the potential of earth, and that the positive plateaux p+ are at the potential of the positive voltage V3.

Figure 8:
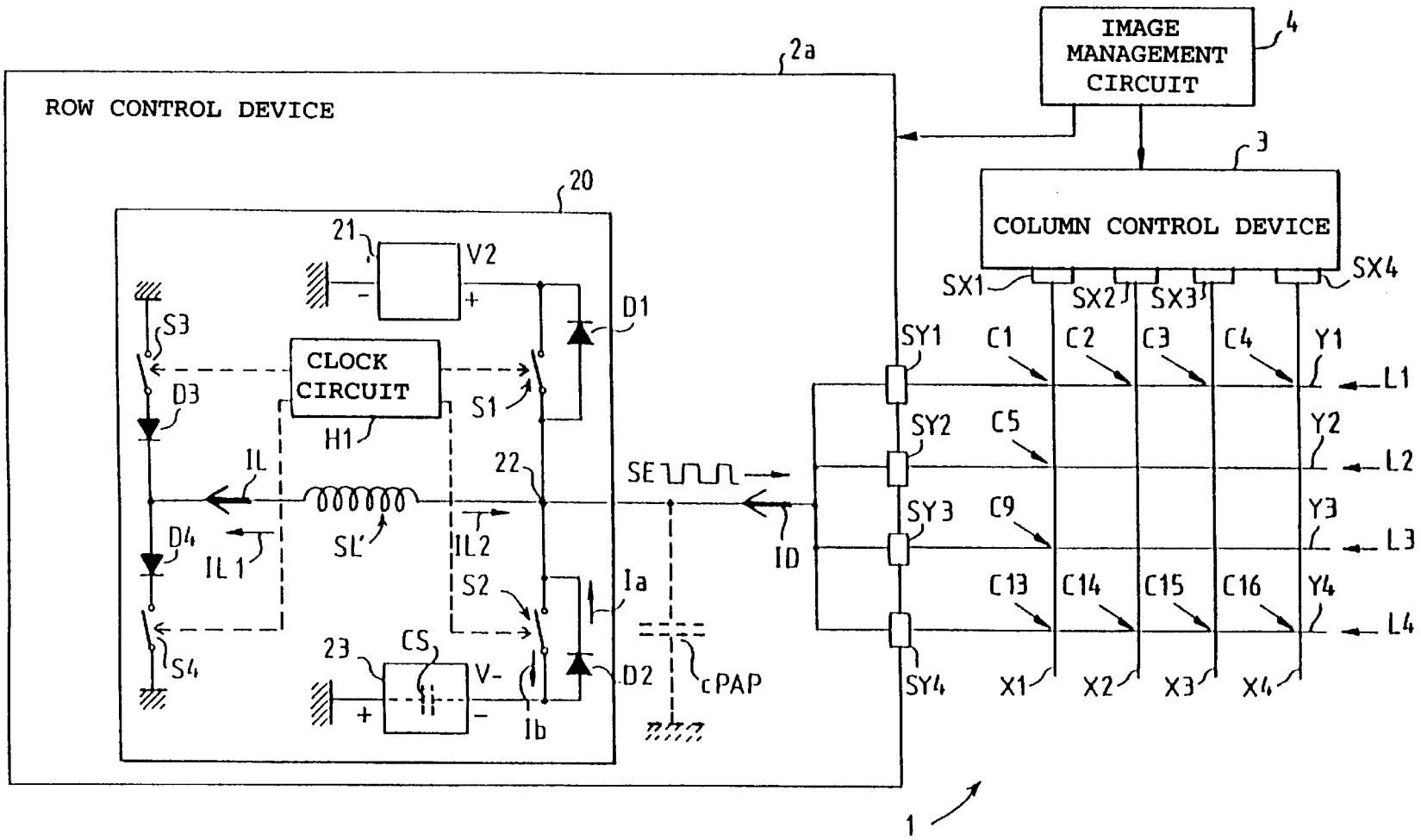
FIG. 8 represents a version of the invention which makes it possible to implement time intervals in which the current in a solenoid possesses a zero value, FIGS. 9*a* to 9*k* constitute a timing diagram illustrating the manner of operation in the version of the invention shown in FIG. 8.

FIG. 8 diagrammatically represents another embodiment of the activation signals generator 20 of the invention, making it possible to obtain operation similar to that described with reference to FIGS. 3 and 4*a* to 4*g*, and additionally making it possible to contrive time intervals during which the main current IL in a solenoid SL' retains a zero value. Thus, by reducing the time for which the current IL passes through the solenoid and through the complete setup, the losses inherent in the passage of this current through the various elements of the setup are diminished.

As compared to the diagram shown in FIG. 3, the signal generator 20 shown in FIG. 8 additionally comprises a third and a fourth diode D2, D4, as well as a third and a fourth switching element or switch S3, S4 whose "on" state or "off" state are controlled by the clock H1.

In this version of the invention, the opposite end of the solenoid SL' from the output point 22 is linked both to the cathode of the third diode D3 and to the anode of the fourth diode D4.

The anode of the third diode D3 is linked to one end of the third switch S3, the other end of which is linked to earth. The cathode of the fourth diode D4 is linked to one end of the fourth switch S4, the other end of which is linked to earth.

Under these conditions, the solenoid SL' cannot actually be linked to earth unless at least one of the third and fourth switches S3, S4 is in the "on" state and likewise unless the third or fourth diode D3, D4 in series with this switch is mounted with the direction of conduction appropriate for conducting the main current IL, which current it may be recalled can possess two opposite directions of flow, in the same period.

It is thus possible to determine time intervals in which the main current IL is zero, by acting on the switches S3, S4 so that the current IL cannot flow between the solenoid SL' and earth. For this purpose, on the one hand the instants are chosen at which the main current IL reaches the zero intensity value in order to disconnect the solenoid from earth. On the other hand, use is made of a solenoid L' of lower value than that of the solenoid L used for the manner of operation explained in particular in FIGS. 3 and 4*a* to 4*g*. A solenoid of lower value, for example 20 microhenrys instead of 30 microhenrys, for the same values of the voltages applied, makes it possible to reduce both the time required for the main current IL to pass from its value of maximum intensity Imax+ or Imax− to its zero value, and also the time required for it subsequently to increase again up to its value of maximum intensity. For example in the case illustrated by FIGS. 4*a* to 4*g*, a duration substantially equal to half that of a positive or negative plateau p+ or p− is imparted by the value of the solenoid SL to the increase in the main current IL. Going from a value of 30 microhenrys to a value of 20 microhenrys reduces the time of increase of the current by around ⅓. It is this difference in duration which is exploited in order to produce the time interval at zero current. This can be applied to the examples of FIGS. 3, 4*a* to 4*g*, 5, 6 and 7, without modifying the length of the positive and negative plateaux p+, p− which form the sustain signals SE or reducing the maximum intensity values Imax+, Imax−.

FIGS. 9*a* to 9*k* form a timing diagram which illustrates the abovementioned manner of operation, making it possible to obtain time intervals during which the solenoid current is maintained at zero.

Figures 9A, 9B, 9C, 9D, 9E, 9F, 9G, 9H, 9I, 9J, 9K:
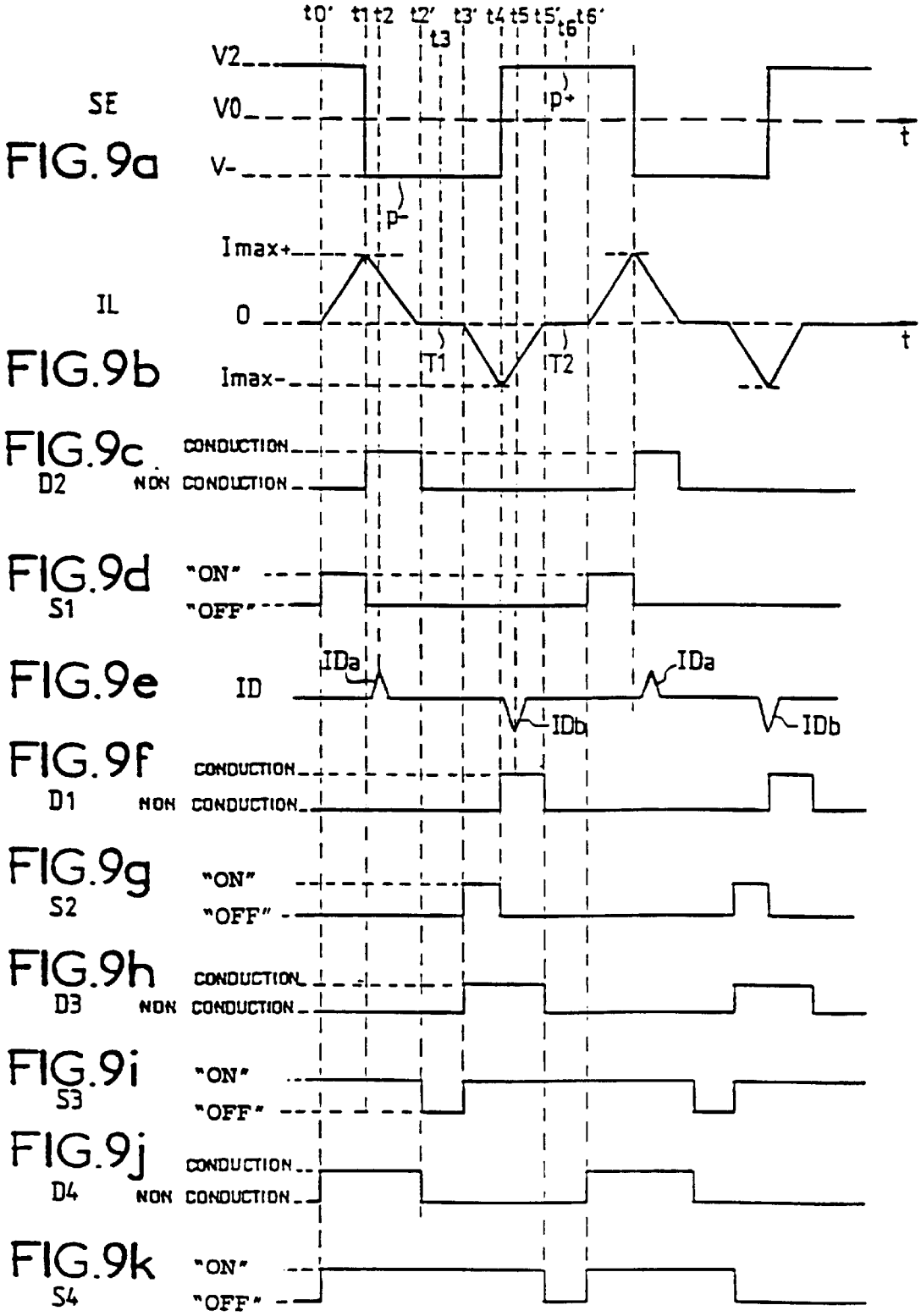

FIG. 9*a* represents the sustain signals SE.

FIG. 9*b* shows the profile of the main current IL in the solenoid L' as a function of time t.

FIG. 9*c* represents conduction by the second diode D2.

FIG. 9*d* represents the "on" or "off" state of the first switch S1.

FIG. 9*e* represents the current spikes IDa, IDb which symbolize the 2 directions of flow of the discharge current ID.

FIG. 9*f* represents conduction by the second diode D2.

FIG. 9*g* represents the "on" or "off" state of the second switch S2.

FIG. 9*h* represents conduction by the third diode D3.

FIG. 9*i* represents the "on" or "off" state of the third switch S3.

FIG. 9*j* represents conduction by the fourth diode D4.

FIG. 9*k* represents the "on" or "off" state of the fourth switch S4.

The following explanations are given for a cycle of operation starting at an instant to', situated later than the instant to of FIGS. 4*a* to 4*g*, with respect to a positive plateau p+. The same label has been retained at the instants which are situated with respect to the positive and negative plateaux p+, p−, in the same way as in FIGS. 4*a* to 4*g*.

At the instant to', the first and fourth switches S1, S4 are set to the "on" state. The main current IL which was zero, begins to increase in the first direction IL1 of flow (with a slope V2/L' which is faster than V2/L, L' being the value of the solenoid SL') towards its value Imax+ which it will attain at the instant t1 at which the first switch S1 turns "off". The fourth diode D4 conducts.

At the instant t1 the manner of operation is similar to that already described for the same instant in FIGS. 4*a* to 4*g*: the first switch S1 is set to the "off" state; the circuit amounts to the solenoid SL' and the capacitor c PAP, and the voltage of the sustain signals SE undergoes a negative transition Tn which causes it to pass from a positive plateau p+ to a negative plateau p−: the second diode D2 begins to conduct; the negative voltage V− is applied to the cells; the main current IL in the solenoid SL' begins to decrease.

At the instant t2 a discharge occurs which consumes a current ID such as represented by the spike IDa.

At the instant t2': the main current IL attains the zero value (more rapidly than in the case of FIG. 4*b*, owing to the lower value of the solenoid SL' in the present example).

The second and fourth diodes D2, D4 cease conducting. The third switch S3 is set to the "off" state, the effect of this being to disconnect as it were the solenoid SL' from earth, in such a way that, even if the second switch S2 is turned "on", it is not possible to impose a (negative) increase of the current IL which thus retains a zero value so long as S3 is off. The start of a first time interval T1 at zero current is thus obtained.

At the instant t3 which is situated with respect to the negative plateau p− in the same way as in the example of FIGS. 4 to 4*g*, the same situation holds as at the instant t2', the current IL being in the interval T1 of zero current.

At the instant t3' the second and third switches S2, S3 are turned "on" and the main current IL begins to increase in the second direction IL2 of flow with a slope equal to V−/L'. The third diode D3 conducts.

At the instant t4, the second switch S2 is "off"; the main current IL has attained its value Imax−. The voltage of the sustain signals SE undergoes a transition Tp which leads to a positive plateau p+ corresponding substantially to the positive voltage value V2. The first diode D1 becomes conducting. The main current IL begins to decrease.

At the instant t5 a discharge occurs which consumes a current ID represented by a spike IDb.

At the instant t5': the main current IL has attained the zero value; the first and third diodes D1, D3 cease conducting; the first and fourth switches S1, S4 are in the "off" state. The solenoid L' is then as it were "disconnected" from earth. This is the start of a second time interval T2 at zero current.

At the instant t6 which is situated in the same way as in FIGS. 4*a* to 4*g* with respect to the positive plateau p+, the same situation holds as at the previous instant t5', the main current IL being in the second interval T2 at zero current.

At the instant t6': the first and fourth switches S1, S4 are turned "on". The main current IL which was hitherto zero begins to increase towards the value of maximum intensity Imax+. This is the end of the second interval T2 at zero current. The instant t6' marks the end of a cycle of operation and the start of a new cycle, which is executed according to the same sequences as those included between the instants to' and t6'.

The invention has been described with reference to an ac plasma panel, of the type having only two crossed electrodes for defining a cell and controlling the operation thereof, but the invention can equally well be applied to all types of ac plasma panels, and it may also be applied to other types of image display screens so long as the activation of their cells calls for a pulse-like current, and so long as these screens comprise a capacitor such as the global capacitor c PAP exhibited by a plasma panel.

What is claimed is:

1. A process for activating the cells of an image display screen, including cyclically producing signals termed "activation signals" and in applying them to the cells, bringing about a consumption of a current termed the "discharge current" by the activated cells, wherein, in order to produce the activation signals, it includes tapping off at the terminals of a solenoid, signals resulting from the application of at least one voltage to the solenoid, and in that it includes causing a current termed the main current to increase up to a maximum intensity value at least equal to the maximum intensity of the discharge current and decrease in the solenoid, at least a part of the current during the decreasing of the said main current, forming the discharge current consumed by the activated cells.

2. The process according to claim 1, further comprising:

tapping off, at the terminals of the solenoid, signals resulting from the successive applications of a positive voltage and of a negative voltage with respect to a reference potential to which the solenoid is linked.

3. The process according to claim 1, further comprising:

establishing the main current in such a way that the decrease in the latter starts before or at the same time as a phase of activation of the cells.

4. The process according to claim 1, wherein the main current is established cyclically with a period equal to a period of the activation signals.

5. The process according to claim 1, wherein in a period of the main current, the process further comprises:

causing the main current to increase up to a maximum intensity value and then to decrease, a first time with a first direction of flow, and a second time with a second direction of flow which is opposite to the first.

6. The process according to claim 1, wherein before each increase, the main current passes through a zero value.

7. The process according to claim 1, further comprising:

establishing the main current in such a way on the one hand, that each decrease in the latter corresponds to a phase of activation of the cells, and possesses the same direction of flow of the current as the direction of flow of the corresponding discharge current, and on the other hand, that each decrease in the main current starts before or at the same time as the corresponding activation phase.

8. The process according to claim 1, further comprising:

imparting a zero value to the main current during a time interval lying between the end of a decrease and the start of the next increase.

9. The process according to claim 1, wherein to cause the main current to increase, the process further comprises:

applying a voltage to the solenoid, and then in removing the application of this voltage in order to cause the main current to decrease.

10. The process according to claim 2, further comprising:

linking a first end of the solenoid to the reference potential, and in linking the second end of the solenoid to an output point where the activation signals are delivered and from where they are transmitted to the display screen.

11. The process according to claim 1, wherein to impart to the activation signals a general shape of strobes defined by a first and a second plateau of opposite polarities following one another alternately, the process further comprises:

applying the positive voltage corresponding to the potential of a first plateau of said activation signals to the solenoid so as to effect the increase in the main current in a first direction of flow, then, at an instant which corresponds to the end of the said first plateau, in ceasing to apply this positive voltage in such a way as to bring about, on the one hand, the end of the increase in the main current, and, on the other hand, to bring about a variation in the voltage across the solenoid engendered by an oscillatory type response of an oscillating circuit including the solenoid associated with a so-called global capacitance exhibited by the screen, then in limiting the variation in voltage to a value corresponding to the potential of the second plateau of the activation signals.

12. The process according to claim 11, further comprising, when the decrease in the main current having the first direction of flow is completed:

applying the negative voltage corresponding to the potential of the second plateau of the activation signals to the solenoid so as to cause the main current to increase in a second direction of flow, then, at an instant which corresponds to the end of the second plateau, in ceasing to apply the negative voltage so as to bring about, on the one hand, the end of the increase in the main current, and to bring about, on the other hand, a variation in the voltage across the solenoid, engendered by an oscillatory response of the oscillating circuit, then in limiting this variation in voltage to a value corresponding to the potential of the first plateau.

13. The process according to claim 10, further comprising:

applying the positive voltage and the negative voltage to the solenoid with the aid respectively of a first and a second switching element, to whose terminals are respectively connected a first and a second so-called clipping diode, each clipping diode being oriented in such a way as to conduct a so-called clipping current having a direction of flow which is the reverse of that of the current which passes through the switching element to which it corresponds.

14. The process according to claim 13, wherein to constitute the positive voltage or the negative voltage, the process further comprises:

using a voltage developed across a so-called storage capacitance by, on the one hand the flow of the clipping current through a clipping diode, and on the other hand by the flow of the current through the corresponding switching element.

15. The process according to claim 2, wherein the reference potential corresponds to the potential of earth.

16. The process according to claim 2, wherein the earth corresponds to the potential of the negative voltage.

17. The process according to claim 16, wherein the positive voltage is obtained with the aid of a storage capacitance.

18. The process according claim 2, further comprising:

applying the positive and negative voltages to the solenoid in such a way as to impart a duty ratio equal to 1 to the activation signals.

19. The process according to claim 2, further comprising:

applying the positive and negative voltages in such a way as to impart a duty ratio different from 1 to the activation signals.

20. The process according to claim 1, wherein the activation signals are effected with a general shape of strobes defined by two plateaux of opposite polarities, and the increase in the main current is effected with a slope such that this increase makes it possible to attain a desired maximum intensity value in a time less than the duration of a plateau.

21. The process according to claim 1, wherein, during time intervals lying between a decrease and an increase which follow the main current, the process further comprises imparting a zero value to the latter.

22. The process according to claim 21, further comprising:

isolating the solenoid from the remainder of the circuit via at least one of its ends during the time intervals in which the main current has a zero value.

23. The process according to claim 1, wherein the activation signals are effected with a general shape of strobes defined by two plateaux of opposite polarities, and the increase in the main current is effected with a slope such that this increase makes it possible to attain a desired maximum intensity value in a time less than the duration of half a plateau of the signals.

24. The process according to claim 1, wherein the display screen includes an ac-type plasma panel.

25. An image display device implementing the process according to claim 1, comprising, a screen having a plurality of cells and exhibiting a so-called global capacitance, a control device delivering activation signals whose application to the cells produces, cyclically, an activation thereof, brings about a consumption of a current termed the discharge current by the activated cells, wherein the control device comprises a solenoid cooperating with switching means and at least one voltage source so as on the one hand, to produce at the terminals of the solenoid, signals serving to form the activation signals, and on the other hand so as to cause a current termed the main current which, at some time in its decrease, serves to form the discharge current consumed by the activated cells, to increase and decrease in the solenoid.

26. The device according to claim 25, wherein the switching means comprise a first switching element cooperating with a clock circuit so as to apply a positive voltage corresponding to the potential of a so-called positive plateau of the activation signals to the solenoid, with respect to a reference voltage.

27. The device according to claim 26, wherein applying the positive voltage brings about the increase in the main current with a first direction of flow.

28. The device according to claim 26, wherein the control device comprises a clipping circuit which limits, to the value of the potential of a negative plateau of the activation signals, a voltage transition developed across the solenoid following the removal of the application to the latter of the positive voltage.

29. The device according to claim 26, further comprising:

a second switching element cooperates with the clock circuit so as to apply a negative voltage corresponding to the potential of a negative plateau of the activation signals to the solenoid, with respect to the reference voltage.

30. The device according to claim 29, wherein applying the negative voltage brings about the increase in the main current with a second direction of flow.

31. The device according to claim 30, wherein the control device comprises a second clipping circuit which limits, to the value of the potential of the positive plateau, a voltage transition across the solenoids resulting from the removal of the application to the solenoid of the negative voltage.

32. The device according to claim 29, wherein the application of the positive or negative voltage to the solenoid is removed when the main current attains substantially a desired maximum intensity value.

33. The device according to claim 32, wherein the maximum intensity value is equal to or greater than that of the discharge current.

34. The device according to claim 29, wherein the increase in the main current is carried out with a slope such that the main current attains a desired maximum intensity value in a time substantially equal to half the duration of one of the plateaux forming the activation signals.

35. The device according to claim 25, further comprising:

means for maintaining the main current at a zero value during time intervals lying between a decrease and an increase which follow the main current.

36. The device according to claim 35, wherein the increase in the main current is carried out with a slope such that the main current attains a desired maximum intensity value in a time less than half the duration of one of the plateaux forming the activation signals.

37. The device according to claim 35, wherein the control device furthermore comprises switching elements making it possible to prevent the establishment of the main current.

38. The device according to claim 29, further comprising:

a so-called storage capacitance cooperating either with the first switching element and the first clipping diode, or with the second switching element and the second clipping diode, so as to produce either the positive voltage or the negative voltage.

39. The device according to claim 1, wherein the reference potential is the potential of earth.

40. The device according to claim 29, wherein the earth corresponds to the potential of the negative voltage.

41. The device according to claim 25, wherein the screen comprises an ac-type plasma panel.

42. A method of activating cells of an image display screen, the method comprising steps of:

applying at least one voltage to a solenoid;

increasing and decreasing a main current in the solenoid;

tapping off signals at terminals of the solenoid resulting from the step of applying said at least one voltage to the solenoid to cyclically produce activation signals; and applying the activation signals to the cells to produce activated cells which consume a discharge current;

wherein, during the decreasing of said main current in the solenoid, at least a part of the main current includes the discharge current consumed by the activated cells.

* * * * *